United States Patent [19]

Wilhelmsson

[11] Patent Number: 4,560,408

[45] Date of Patent: Dec. 24, 1985

[54] METHOD OF USING CHROMIUM-NICKEL-MANGANESE-IRON ALLOY WITH AUSTENITIC STRUCTURE IN SULPHUROUS ENVIRONMENT AT HIGH TEMPERATURE

[75] Inventor: Per H. Wilhelmsson, Ekostigen, Sweden

[73] Assignee: Santrade Limited, Lucerne, Switzerland

[21] Appl. No.: 616,299

[22] Filed: Jun. 1, 1984

[30] Foreign Application Priority Data

Jun. 10, 1983 [SE] Sweden ..... 8303301

[51] Int. Cl.[4] ..... C22C 38/58

[52] U.S. Cl. ..... 75/128 A; 75/128 N; 420/584; 420/585; 420/586

[58] Field of Search ..... 75/128 A, 128 N, 128 G, 75/128 B, 128 T, 128 V, 128 W; 148/38; 420/584, 585, 586

[56] References Cited

U.S. PATENT DOCUMENTS

| | | | |
|---|---|---|---|
| 3,311,511 | 3/1967 | Goller | 75/128 N |
| 3,401,036 | 9/1968 | Dulis et al. | 75/128 R |
| 3,552,950 | 6/1967 | Rundell et al. | 420/584 |
| 3,592,634 | 7/1971 | Denhard | 75/128 A |
| 3,969,109 | 7/1976 | Tanczyn | 75/128 A |
| 4,302,247 | 11/1981 | Abe et al. | 75/128 A |
| 4,329,173 | 5/1982 | Culling | 75/128 A |
| 4,390,367 | 6/1983 | Niehaus et al. | 148/38 |

FOREIGN PATENT DOCUMENTS

| | | |
|---|---|---|
| 1258111 | 1/1968 | Fed. Rep. of Germany . |

*Primary Examiner*—L. Dewayne Rutledge
*Assistant Examiner*—Deborah Yee
*Attorney, Agent, or Firm*—Burns, Doane, Swecker & Mathis

[57] ABSTRACT

As a construction material in sulphurous environments at high temperatures it has according to the invention been found advantageous to use an austenitic chromium-nickel-manganese alloy having a relatively high content of manganese such as 3–12% and preferably 3–8%.

2 Claims, No Drawings

METHOD OF USING CHROMIUM-NICKEL-MANGANESE-IRON ALLOY WITH AUSTENITIC STRUCTURE IN SULPHUROUS ENVIRONMENT AT HIGH TEMPERATURE

The present invention relates to an austenitic manganese-alloyed construction material for use at high temperatures and in sulphurous environments. The material is characterized of an improved corrosion resistance in sulphidizing environments; excellent mechanical properties at high temperature, such as good creep strength and creep ductility, and small tendency of embrittlement.

The development towards a better utilization of fossil fuels of lower qualities having high contents of the impurity elements sulphur, vanadium and chlorine, has given rise to an increasing need of construction materials being resistant to corrosion attacks caused by said impurities. Furthermore, the development goes towards energy systems working at higher temperatures which involves greater demands upon the construction materials.

Besides resistance to corrosion in flue gas environments, it is demanded that the materials for these plants or establishments have sufficiently good creep properties at temperature of uses. The materials must also have a stable structure without tendency towards precipitation of phases which make the material brittle at shutdown of the establishment or which impairs the creep properties after long operating times. It is also important that the material has good weldability and bendability in order to facilitate the construction and repair of plants utilizing fossil fuels.

The present invention is based on the discovery of alloying compositions which fulfill the demands being raised upon construction materials in sulphurous environments concerning corrosion resistance, creep strength, structure stability, weldability, ductility etc. Earlier used high temperature steels have, in some respect, not met these demands satisfactorily. In such cases where corrosion has been regarded as the most important factor, ferritic chromium steels have often been used because nickel is unfavourable for the corrosion resistance. In order to increase the resistance to sulphidation and oxidation these steels can be alloyed with aluminium. Ferritic chromium steels have, however, considerable drawbacks. They have low creep strength. If the contents of chromium, and in particular the contents of aluminium, are high, they will also be brittle and difficult to weld and bend. The low creep strength means that they can only be used in systems not being under pressure or as a coating on creep resistant austenitic steels or on nickel base alloys.

Another corrosion resistant, often used type of alloy has the basic composition 50Cr, 50Ni. Also this kind of alloy has, however, several disadvantages. It is difficult to work in hot as well as in cold condition, it has low creep strength and it is expensive because of its high content of nickel.

Austenitic materials offer many advantages. They have high creep strength and are easy to weld and bend because they are more ductile.

Austenitic materials have, however, the great disadvantage that they are generally less resistant to sulphidation, mainly because they contain nickel. As a consequence it is attempted to eliminate the corrosion problems in sulphurous environments by reducing the amount of sulphur,. i.e. using more pure fuels or by lowering the temperature of the material. But decreased material temperatures will also lead to decreased efficiencies.

One main aim with the present invention is to avoid the drawbacks of present steel grades and to reach good resistance to sulphur corrosion without renouncing the mechanical and the manufacturing properties. Characteristic of the alloy according to the invention is above all the optimal addition of manganese. Manganese favours the resistance in sulphurous environment because it influences the composition of the protecting oxide layer and because it forms stable sulphides which prevent continuous sulphidation/oxidation attacks.

In iron base alloys which form protecting oxide layers by help of Cr at high temperatures, the composition of the oxide will vary in the layer. Innermost there is a chromium rich oxide layer essentially consisting of $Cr_2O_3$, through which Mn, Cr, Fe or other anions are transported out towards the surface and contact with the gaseous phase, wherein iron- and manganese spinels $M_2O_3xMO$ (in which M represents an arbitrary metal) are formed. The transport through the tight, chromium-rich $Cr_2O_3$ is determining the rate of the oxidation. Because manganese usually is present only in small amounts in iron based high temperature alloys the iron content of the spinel increases inasmuch as the diffusion rate of metal ions in $Cr_2O_3$ decreases in the order Mn, Fe, Ni and Cr.

In environments where sulphur is present at the same time as oxygen there are risks of rapid attacks of sulphur, sulphidation, or rather rapid simultaneous sulphidation/oxidation attacks. In order to obtain acceptably low corrosion rates it is trusted on alloys which form protecting oxide layers, similarly to pure oxidation. Sulphur can, however, be transported through protecting oxide layers and form sulphides in the boundary surface oxide/metal. These sulphides can then be oxidized, at which sulphur is made free and goes further into the metal. The process is repeated and rapid attacks may take place.

An addition of manganese to chromium oxide forming alloys neutralizes said attacks because manganese-rich spinel is more stable than iron or nickel-rich spinel and reduces the transport of sulphur through the oxide layer. Furthermore, if sulphur penetrates the oxide layer there are formed stable manganese sulphides in the matrix, which sulphides do not tend to be oxidized. In this way sulphidation/oxidation attacks are prevented.

The invention relates to a chromium-nickel-manganese-iron alloy with austenitic structure and containing (in % by weight):

| | |
|---|---|
| Carbon | up to 0.5 |
| Silicon | up to 3.0 |
| Manganese | 3-12 |
| Chromium | 18-30 |
| Nickel | 11-35 |
| Tungsten, Molybdenum, Vanadium, Tantalum | in total, up to 4 |
| Titanium | up to 0.5 |
| Aluminium | up to 0.5 |
| Boron | up to 0.1 |
| Nitrogen | up to 0.3 |
| REM (rare earth metal) | up to 0.2 |
| Zirconium | up to 0.2 |
| Cobalt | up to 10 |
| Niobium | up to 3 |
| Iron | remainder (Besides usual impurities) |

The alloy is used at high temperatures such as at the lowest 300° C. and usually at the lowest 450° C. The sulphurous environment generally consists of flue gases or similar being formed by combustion, gasification or similar operations of fuels and similar with a sulphur content of at the lowest 0.2%. Often the content of sulphur is higher than 0.5%.

Manganese is an often used alloying element in stainless steels and nickel base alloys. In valve steel for Diesel and petrol engines manganese is an important alloying element.

Thereby, the most important function of manganese is to increase the solubility of carbon and nitrogen in order to give high contents of said elements meaning an improved hot hardness. In for example the U.S. Pat. No. 2,495,731, so called 21-4N and 21-2N steels and modifications thereof are described. The basic composition is 0.5% carbon, 9.0% manganese, 21% chromium, 3.35% nickel, 0.45% nitrogen, the rest being iron. These steels are optimized regarding strength, hot hardness and resistance to lead-induced corrosion. On the other hand, they are not suited to sulphurous environments, in systems set under pressure where great demands are put upon mechanical properties such as structure stability and ductility at high as well as low temperature. From this point of view they have too high contents of carbon and nitrogen.

Another manganese alloyed steel is described by the U.S. Pat. No. 3,552,920. Manganese is added in contents between 4–20% and chromium between 12–40% to alloys with 34–70% Ni. The alloy is optimized mainly with respect to corrosion because of lead oxide. Manganese as well as nickel are said to have favourable effects in this respect. The disadvantage of this alloy is among other things the high content of titanium, 1.5–3% in the preferred range. So high contents give deteriorated resistance in sulphurous environment.

The composition of the alloy according to the invention is carefully balanced. The content of manganese should be in the range of 3–12%, at low contents of nickel preferably in the more restricted intervals 3–8%. The lower limit is determined by the content needed to reach an improved resistance to sulphidation. At too high contents, on the other hand, the structure stability and the oxidation resistance in air are impaired too much. Manganese has a slight sigma phase promoting effect. At high contents of nickel, higher contents of manganese can well be used in order to neutralize the negative effects of nickel on the resistance to sulphidation, preferably 6–12%. The influence of manganese upon the structure stability has also smaller importance at high contents of nickel.

The chromium content is of great importance for the resistance to sulphidation as well as oxidation and it should be at least 18%. Above 28–32% Cr, depending upon the content of nickel, there will be problems with the structure stability because chromium is a ferrite stabilizer and favours sigma phase precipitation. The higher chromium content, the more Ni or N have to be added in order to reach the necessary, stabile austenite structure. Because the solubility of N is limited and nickel is unfavourable for the resistance to sulphidation, the content of chromium should not be greater than what needed to obtain a satisfactory resistance, meaning that a suitable chromium range usually is 20–25%.

The nickel content should be as low as possible with respect to corrosion resistance in sulphurous environments, while it should usually be high with respect to mechanical properties. In order to obtain an austenitic structure with small tendency to sigma phase formation the nickel content must be sufficiently high in relation to the chromium content. The necessary Ni content for structure stability can be decreased, however, if nitrogen is added. The amount of nitrogen which can be dissolved is influenced by manganese and the ratio Cr/Ni. From this fact follows that the contents of Mn, Ni, Cr and N have to be carefully balanced.

The nitrogen content is of importance in said balancing. A high content of nitrogen improves the austenite stability and counteracts sigma phase embrittlement. Nitrogen is also favourable for the resistance to low cycle fatigue by promoting planar slip. High contents of nitrogen also increase the yield and creep strength. If nitrogen is added, however, additions of elements with strong affinity to nitrogen, such as Al, Zr, Nb, Ti and other, have to be avoided. But the nitrogen content must not be too high because high contents decrease the creep ductility and impact strength at room temperature after use. A suitable interval based upon said considerations is 0.05–0.30% in those cases where no element with great nitrogen affinity is added.

An austenitic alloy with relatively low nickel content and relatively high nitrogen content, and which has been successfully used for the particular use according to the invention, has shown the following composition (in % by weight):

| | |
|---|---|
| C | 0.03–0.12 |
| Si | up to 0.6 |
| Mn | 3–8 |
| Cr | 19–25 |
| Ni | 11–19 |
| W, Mo, V, Ta | in total, <1 |
| Nb | <0.1 |
| Ti | <0.1 |
| Al | <0.1 |

-continued

| | |
|---|---|
| B | <0.008 |
| N | 0.05-0.30 |
| Zr | <0.05 |
| REM | <0.20 |
| Fe | rest (besides usual impurities) |

In order to improve the resistance in sulphurous environment, niobium can be added, whose favourable effect is additive to the earlier described, favourable effect of manganese. Nb influences the protecting ability of the oxide layer. Addition of Nb also improves the creep strength. In order to obtain marked effects, the content of niobium should exceed 0.3%. A too high Nb content impairs the hot ductility and makes the hot working more difficult. Nb is also an expensive alloying element. More than 1.5% should therefore not be added. If Nb is added, the nitrogen content should be below 0.10% in order to avoid difficulties in the hot working. The above-mentioned niobium contents are also optimized with respect to creep strenght. Nb leads to precipitation of niobium carbides and niobium nitrides, which give a particle hardening. At too high Nb contents, however, the structure stability is impaired, which is negative for the creep strength.

A niobium containing alloy with a relatively high content of nickel and very good structure stability, and which has favourably been used for the special purpose of the invention, has shown the following composition (in % by weight):

| | |
|---|---|
| C | 0.03-0.12 |
| Si | 0.05-1.0 |
| Mn | 3-8 |
| Cr | 18-25 |
| Ni | 27-35 |
| W, Mo, V, Ta | in total, <3 |
| Nb | 0.2-1.8 |
| Ti | up to 0.5 |
| Al | up to 0.5 |
| B | <0.008 |
| N | 0.01-0.15 |
| Zr | <0.05 |
| Fe | rest (besides usual impurities) |

Depending upon the balance of Cr, Ni, N, Mn and Nb, the nickel content can be varied within the wide interval 11-35%. If high contents of nitrogen is added, the nickel content should be in the more restricted interval 11-19%. If niobium is added together with manganese in order to increase the resistance to sulphidation, nitrogen can not be added why nickel alone will stand for the structure stability. A content of 27% is then necessary for good stability of the structure. A greater content than 31% will, however, give a deteriorated resistance to sulphidation, but is sometimes necessary for the mechanical properties.

The nickel content can, however, be chosen lower also at niobium additions, if, instead, the chromium content is lower and the demands upon structure stability are lower. An alloy according to the present invention with good resistance to sulphidation has shown the following composition (in % by weight):

| | |
|---|---|
| C | 0.03-0.12 |
| Si | 0.1-0.5 |
| Mn | 3-8 |
| Cr | 18-24 |
| Ni | 20-26 |
| W, Mo | in a total, up to 1.5 |
| Nb | 0.3-1.0 |
| N | 0.01-0.08 |
| REM | up to 0.2 |
| Fe | rest (besides usual impurities) |

Carbon contributes to an improved creep strength by precipitating carbides during creep. In wrought alloys the carbon content should not be too high, however, at the most 0.15%, because problems otherwise are found in the hot working. But also the creep ductility is impaired at higher contents of carbon. Too small carbon contents, below 0.03%, give insignificant contribution to the creep strength.

If the product is used in cast condition, a higher carbon content can be allowed. In this way an improved creep strength is obtained. An optimal interval is 0.2-0.5%. If the carbon content is above 0.5%, the creep ductility will be too low, however. Too high contents of carbon are also unfavourable because chromium will be bound in carbides, which deteriorates the resistance to oxidation and sulphidation.

A cast alloy according to the invention with improved resistance to sulphidation has shown the following composition (in % by weight):

| | |
|---|---|
| C | 0.2-0.5 |
| Si | up to 3 |
| Mn | 3-8 |
| Cr | 20-28 |
| Ni | 20-35 |
| W, Mo, V, Ta | in total, up to 4 |
| Nb | 0.5-2 |
| Ti | <0.1 |
| Al | <0.1 |
| B | <0.008 |
| N | <0.10 |
| Zr | <0.5 |
| REM | <0.5 |
| Fe | rest (besides usual impurities) |

Silicon is harmful for the corrosion resistance in sulphurous environment. Silicon also increases the tendency to sigma phase precipitation very much. For these reasons the content of silicon should be as low as possible. For manufacturing reasons, such as smelt metallurgical, i.e. desoxidation, a content of at least 0.1% is demanded, however, in cast material a higher content. In wrought material, a higher content than 0.5% should not be allowed with respect to the properties of uses.

A well optimized addition of rare earth metals in the form of "Mischmetall" is preferably added to the alloy according to the invention in order to give an improved oxidation resistance and hot workability. The effect of increased hot workability is particularly important when niobium is an alloying element. The total content of rare earth metal should not be less than 0.05% in order to make sufficient improvements but should not be above 0.15%, because the structure in such case would be too rich in inclusions.

Optimal amounts of substitionally dissolved elements and strong carbide formers such as W, Mo, Co, Cu, Ta, V, Ti may be added to increase the strength. Aluminium in combination with titanium may be added in order to give a hardening gamma-prim-precipitation at higher contents of nickel.

In alloys with high nickel contents, it is favourable for the resistance to sulphidation, however, to avoid strengthening titanium and aluminium additions. A well balance composition according to the invention with good resistance to sulphidation has shown to be:

| | |
|---|---|
| C | 0.03–0.10 |
| Si | 0.1–0.5 |
| Mn | 3–8 |
| Cr | 20–25 |
| Ni | 27–35 |
| Mo + W | up to 3 |
| Nb | 0.3–1.2 |
| Fe | rest (besides usual impurities) |

Alloy compositions according to the present invention have shown good properties at sulphidation and oxidation tests. Examples of compositions of an alloy according to the present invention are given in Table 1. Tables 2 and 3 show total corrosion, including scaling, formation of oxide layers and internal oxidation and sulphidation, after testing in $CaSO_4$+10% C mixture at 900° C. for 10×24 h with a change of mixture after each cycle. This type of test gives sulphidation in the form of sulphide formation below an oxide layer. The result of the corrosion test shows that the alloy according to the invention has a considerably better resistance than the alloy "Alloy 800H" having relatively high contents of Cr and Ni but a conventional content of Mn.

Cyclic oxidation testing at 1000° C., with 3000 cycles using 15 min at high temperature and 5 min cooling at room temperature show that alloys according to the present invention can reach the same oxidation resistance as "Alloy 800H", see Table 4, which has, however, as been mentioned earlier, considerably lower resistance to sulphidation, see Table 2.

TABLE 2

| Result of corrosion test 10 × 24 h in $CaSO_4$ + 10% C at 900° C. | | |
|---|---|---|
| Alloy | Total corrosion in μm | Weight change g/m² h |
| 1 | 140 | −53 |
| | 150 | −52 |
| 2 | 160 | −26 |
| | 150 | −55 |
| 3 | 190 | −29 |
| | 120 | −32 |
| 4 | 150 | −7 |
| | 125 | −6 |
| 5 | 25 | +7 |
| | 100 | +7 |
| 6 | 100 | +5 |
| | 150 | +5 |
| 7 | 250 | −389 |
| | 150 | −213 |
| 8 Alloy 800H | 950 | −1188 |
| | 760 | −842 |

TABLE 3

| Result of corrosion test 20 × 24 h in $CaSO_4$ + 5% C at 900° C. | | | | |
|---|---|---|---|---|
| | Total corrosion in μm after test Number of cycles | | | |
| Alloy | 5 | 10 | 15 | 20 |
| 5 | 20 | 40 | 55 | 60 |
| 6 | 50 | 80 | 125 | 125 |
| 8 | 300 | 665 | 665 | 860 |
| 9 | 60 | 60 | 75 | 100 |
| 10 | 80 | 100 | 150 | 225 |

TABLE 4

| Result of cyclic oxidation test | | |
|---|---|---|
| Alloy | % Mn | Weight loss after oxide removal mean value of two determinations, g/m² h |
| 6 | 4.0 | 1.84 |
| 7 | 6.4 | 1.93 |
| 8 Alloy 800H | 0.6 | 1.87 |

I claim:

1. In a process using a construction material in a sulphurous environment at a temperature of at least 300° C., in which the sulphurous environment consists of flue gases or similar media being formed by combustion or equivalent operations of fuels having a sulphur content of at least 0.2%, the improvement which comprises using as the construction material a chromium-nickel-manganese-iron alloy with austenitic structure consisting essentially of (in % by weight):

TABLE 1

| | Chemical composition of alloys | | | | | | | | | | | | |
|---|---|---|---|---|---|---|---|---|---|---|---|---|---|
| Charge nr | C | Si | Mn | P | S | Cr | Ni | Mo | Nb | Ti | Al | Ce* | N |
| 1 917 | 0.055 | 0.11 | 4.4 | 0.012 | <0.003 | 25.8 | 15.3 | — | — | — | 0.013 | 0.03 | 0.27 |
| 2 918 | 0.054 | 0.14 | 8.6 | 0.012 | <0.003 | 25.5 | 15.4 | — | — | — | 0.017 | 0.04 | 0.27 |
| 3 920 | 0.052 | 0.10 | 9.2 | 0.012 | 0.04 | 26.2 | 15.1 | — | 0.23 | — | 0.003 | 0.04 | 0.27 |
| 4 899 | 0.056 | 0.13 | 3.48 | 0.012 | <0.003 | 23.4 | 27.6 | — | — | — | 0.021 | 0.08 | 0.090 |
| 5 902 | 0.061 | 0.14 | 3.84 | 0.016 | <0.003 | 23.5 | 27.0 | — | 0.79 | 0.17 | 0.022 | 0.08 | 0.047 |
| 6 923 | 0.048 | 0.12 | 4.0 | 0.009 | 0.006 | 21.5 | 29.3 | — | — | 0.20 | 0.002 | — | 0.040 |
| 7 924 | 0.053 | 0.11 | 6.4 | 0.009 | 0.006 | 21.5 | 29.1 | — | — | 0.25 | 0.002 | — | 0.028 |
| 8 Alloy 800H | 0.068 | 0.56 | 0.55 | — | — | 20.8 | 30.6 | — | — | 0.47 | 0.48 | — | — |
| 9 458 | 0.030 | 0.52 | 5.01 | — | — | 19.6 | 24.5 | 0.91 | 0.75 | — | — | — | — |
| 10 TP 310 | 0.12 | 0.71 | 1.74 | — | — | 24.36 | 20.47 | — | — | — | — | 0.08 | 0.081 |

*The content of Ce corresponds to double the amount of "Mischmetall"

| | |
|---|---|
| C | 0.03–0.12 |
| Si | 0.05–1.0 |
| Mn | 3–8 |
| Cr | 18–25 |
| Ni | 27–35 |
| W, Mo, V, Ta | in total, <3 |
| Nb | 0.2–1.8 |
| Ti | up to 0.5 |
| Al | up to 0.5 |
| B | <0.008 |
| N | 0.01–0.15 |
| Zr | <0.05 |
| Co | up to 10 |
| Fe | rest (besides usual impurities). |

2. In a process using a construction material in a sulphurous environment at a temperature of at least 300° C., in which the sulphurous environment consists of flue gases or similar media being formed by combustion or equivalent operations of fuels having a sulphur content of at least 0.2%, the improvement which comprises using as the construction material a chromium-nickel-manganese-iron alloy with austenitic structure consisting essentially of (in % by weight):

| | |
|---|---|
| C | 0.2–0.5 |
| Si | up to 3 |
| Mn | 3–8 |
| Cr | 20–28 |
| Ni | 20–35 |
| W, Mo, V, Ta | in total, up to 4 |
| Nb | 0.5–2 |
| Ti | <0.1 |
| Al | <0.1 |
| B | <0.008 |
| N | <0.10 |
| Zr | <0.5 |
| REM | <0.5 |
| Co | up to 10 |
| Fe | rest (besides usual impurities). |

* * * * *